US007140532B2

(12) United States Patent
Holt et al.

(10) Patent No.: US 7,140,532 B2
(45) Date of Patent: Nov. 28, 2006

(54) CONTAINER WITH INTEGRAL COMPARTMENTS

(75) Inventors: Timothy E. Holt, Evergreen, CO (US); David A. Roelle, Marietta, GA (US); Wayne J. Leybeck, Mesa, AZ (US)

(73) Assignee: Aricoga Creative Development, LLC, Evergreen, CO (US)

( * ) Notice: Subject to any disclaimer, the term of this patent is extended or adjusted under 35 U.S.C. 154(b) by 0 days.

(21) Appl. No.: 11/188,419

(22) Filed: Jul. 25, 2005

(65) Prior Publication Data

US 2006/0016863 A1 Jan. 26, 2006

Related U.S. Application Data

(60) Provisional application No. 60/591,016, filed on Jul. 25, 2004.

(51) Int. Cl.
*B65D 25/04* (2006.01)
*B65D 5/36* (2006.01)

(52) U.S. Cl. ..... 229/120.13; 229/193; 229/400; 229/405; 229/904; 229/906

(58) Field of Classification Search ..... 229/120.13, 229/400, 405, 902, 904, 906, 193; 220/23.8, 220/23.86, 505, 520
See application file for complete search history.

(56) References Cited

U.S. PATENT DOCUMENTS 1,478,838 A * 12/1923 Reifsnyder ..... 229/400
4,126,261 A * 11/1978 Cook ..... 229/904
4,955,528 A * 9/1990 Schluckebier ..... 229/400
5,626,283 A 5/1997 Mellon
5,630,544 A 5/1997 Shane
5,720,429 A 2/1998 Cordle
5,875,957 A 3/1999 Yocum
6,102,208 A 8/2000 Huang
6,119,930 A 9/2000 Lunstra et al.
6,182,890 B1 * 2/2001 Sattler et al. ..... 229/400
6,349,874 B1 2/2002 Hill
6,471,119 B1 10/2002 Cai
6,543,679 B1 * 4/2003 Cai et al. ..... 229/906
6,588,652 B1 7/2003 Cai
6,705,514 B1 3/2004 Pellati

FOREIGN PATENT DOCUMENTS

AU 642389 B * 10/1993
DE 8808196.6 U1 * 10/1988
GB 2147275 A * 5/1985

* cited by examiner

*Primary Examiner*—Gary E. Elkins
(74) *Attorney, Agent, or Firm*—Leslie P. Kramer; Faegre & Benson, LLP

(57) ABSTRACT

A container for holding at least two items comprising at least two compartments, a first compartment and a second compartment rotatably affixed to the first compartment. The second compartment in a first position extends from the first compartment substantially in the plane of the rear panel of the first compartment and can thus be used as a scoop to scoop a first item into the first compartment. The second compartment is then rotated until it is adjacent to and extends substantially along or even abuts the rear panel of the first compartment and is expanded, and a second item is placed into the second compartment.

18 Claims, 6 Drawing Sheets

Fig. 4
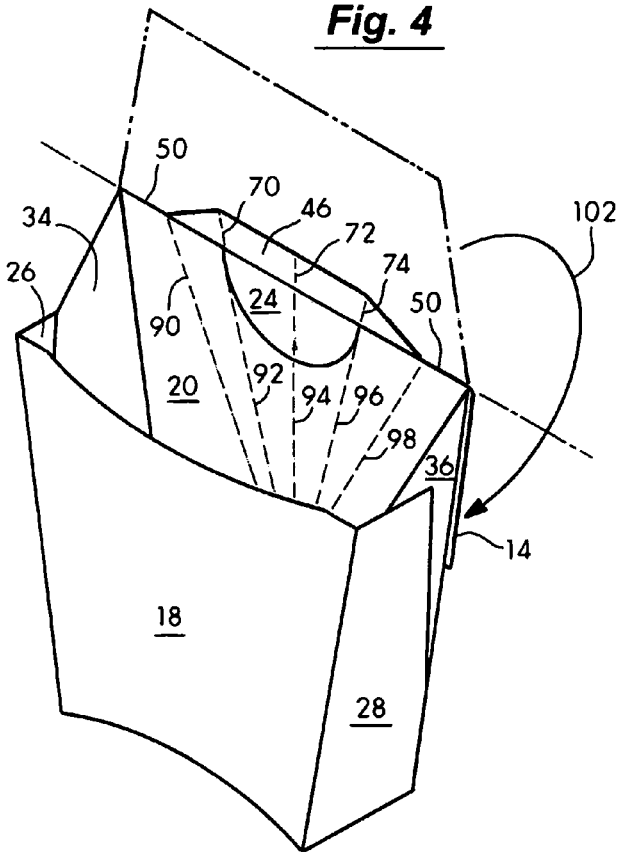
Fig. 5
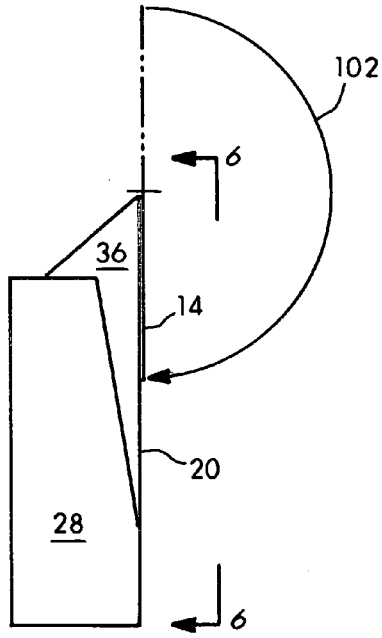
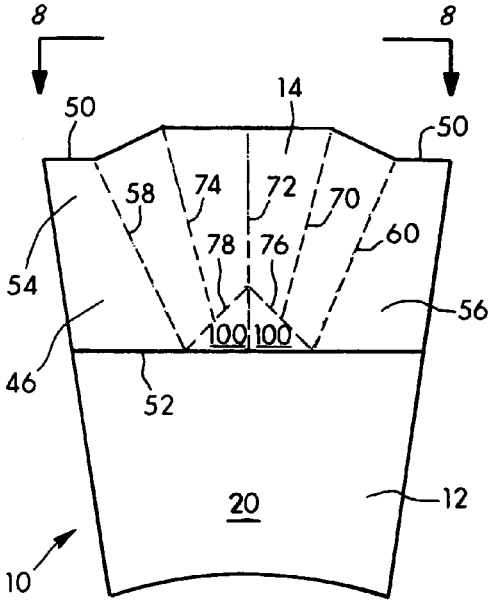
Fig. 6
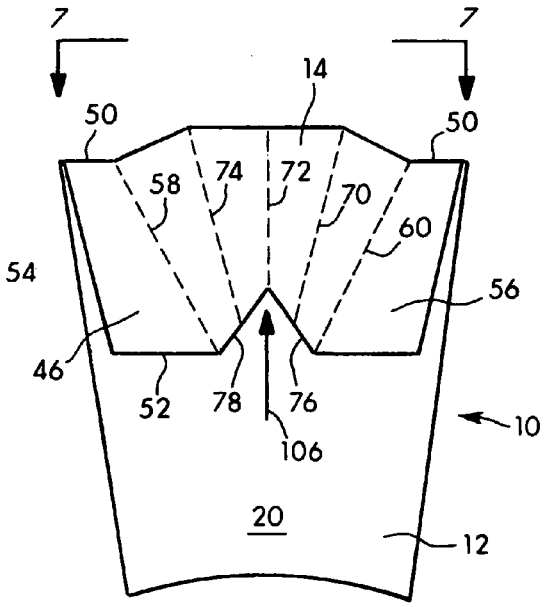
Fig. 9

Fig. 8
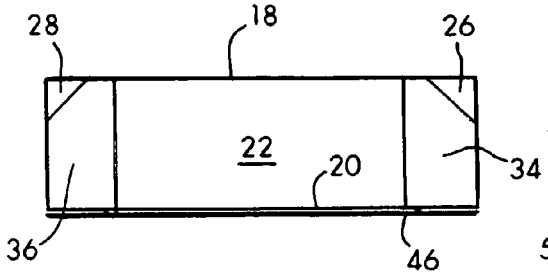
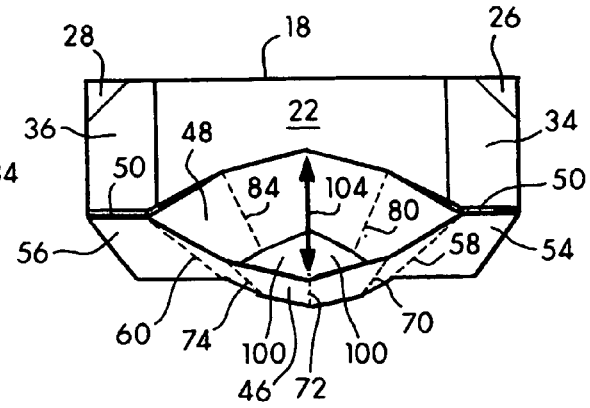
Fig. 7
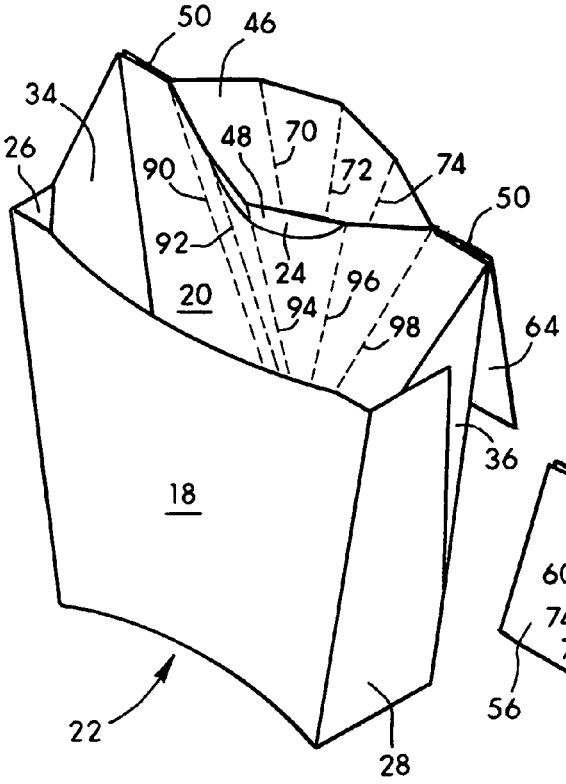
Fig.10
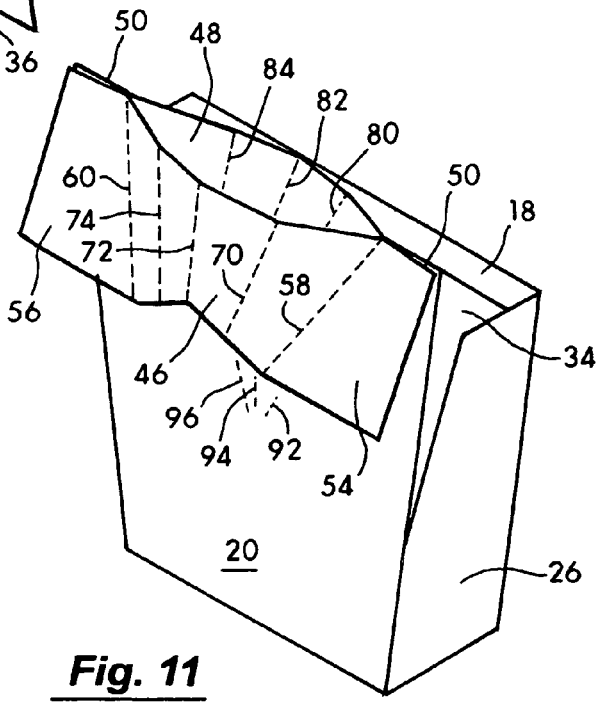
Fig. 11

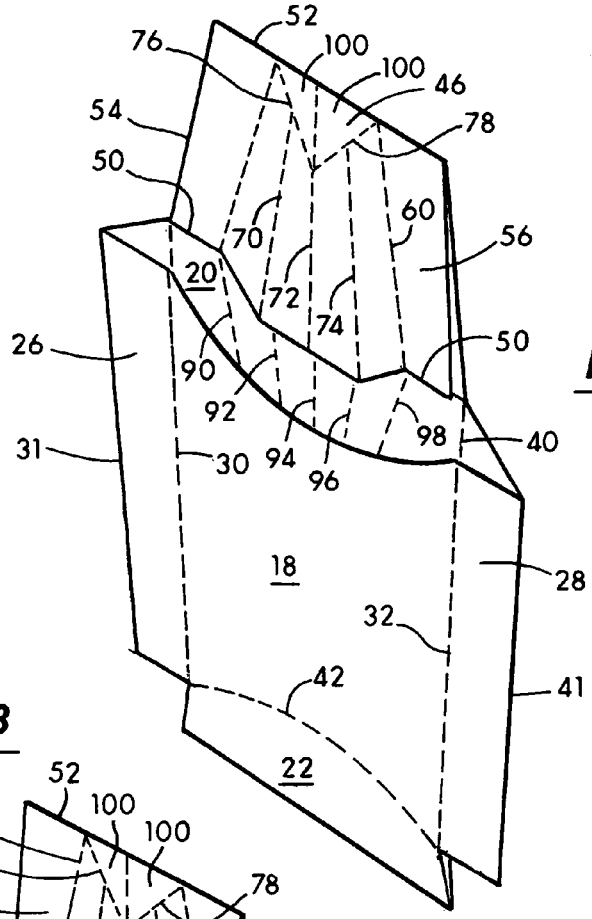
Fig. 12
Fig. 13
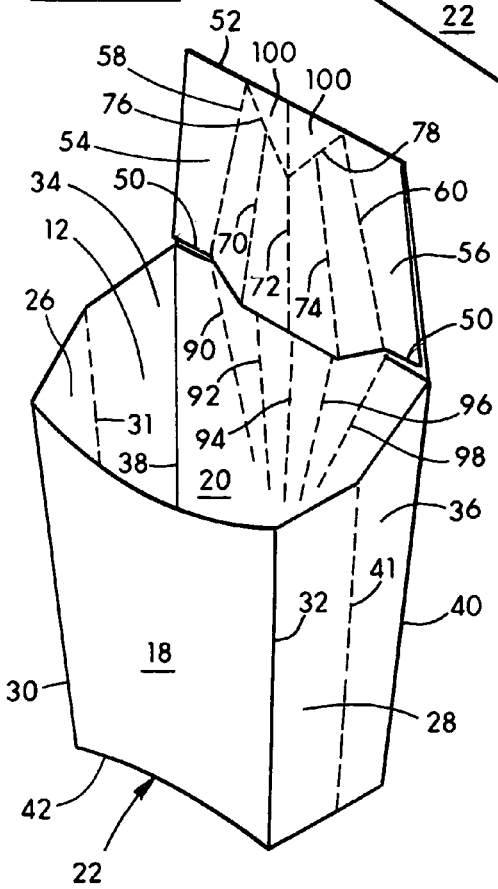
Fig. 14
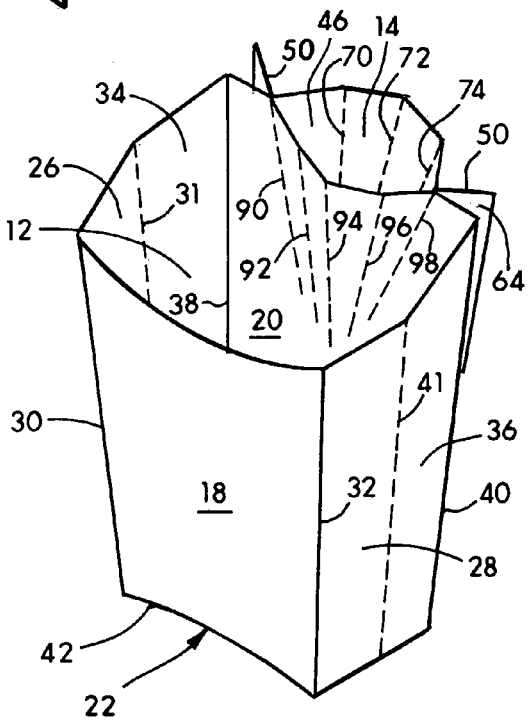

CONTAINER WITH INTEGRAL COMPARTMENTS

RELATED APPLICATION

This application claims the benefit of U.S. Provisional Patent Application Ser. No. 60/591,016 filed Jul. 25, 2004, which is incorporated herein by reference.

BACKGROUND OF THE INVENTION

1. Field of the Invention

The present invention is directed to a container for co-packaging at least two items, in at least two integral compartments, and in which a second compartment rotates from a first position for scooping to a second position for holding at least one item.

2. Discussion of the Background

At fast food restaurants and at take-out counters, french fries are often sold in paperboard containers. Many people like to apply ketchup to french fries. If it is applied directly to the fries in the container, they tend to become soggy. When people reach into the container, they are quite likely to cover their fingers with the ketchup. Alternatively, one can obtain a small separate container of ketchup, into which a french fry may be dipped immediately before it is eaten. But this has the disadvantage of requiring two separate containers. If one is not sitting in a restaurant, one must use one hand to hold the french fry container and one hand to hold the condiment container, making it difficult to eat the french fries. If one is eating the french fries in a car while driving, it is difficult to avoid soiling one's clothes with ketchup when moving the french fries from the condiment container to the mouth.

A similar problem exists with other types of food to which a condiment is preferably applied before eating, such as salads and dressings or vegetables or chips and dips.

Prior containers have attempted to solve this problem by providing containers having integral smaller containers. However, these containers have some disadvantages. For example, the container shown in U.S. Pat. No. 6,119,930 has four bottom panels, which are intricately die cut and scored, so as to interlock when the carton is formed. The intricate die cutting adds substantially to the cost of manufacturing the carton. Also, the relative complexity of the four interlocking bottom panels make it subject to malfunction. Furthermore, the bottom formed by the four interlocking panels is not entirely flat and is relatively small in diameter. This makes it rather tippy and unable to be securely placed on a surface rather than being held at all times. Similar disadvantages accrue to the containers disclosed in U.S. Pat. Nos. 6,705,514, 6,471,119, and 5,875,957.

Another disadvantage of the prior containers is that when the smaller integral container is affixed on the rear panel of the container, as in U.S. Pat. Nos. 6,102,208, 6,119,930, 6,471,119, and 6,705,514, the container cannot easily be used to scoop the food item of interest into the container, as the movement of the food item into the container during scooping tends to pull open the smaller integral container.

The container shown in U.S. Pat. No. 5,626,283 avoids the latter problem by placing the smaller container on the front of the container. However, in this container the smaller container is defined by an elaborate extension and modification of the blank, with access to the smaller container requiring severance along a perforated cut line. Another container shown in U.S. Pat. No. 5,875,957 also provides a smaller container on the front panel of the container. However, this smaller container is formed from a separate sheet of material that is affixed by adhesive to the blank forming the container. This is an extra step in manufacturing that leads to increased expense and time in the manufacturing process. It also leads to the greater possibility of the smaller container to become unattached from the larger container should the adhesive fail to hold.

A container having a smaller integral container on the inside of a side panel is shown in U.S. Pat. No. 5,720,429. In this container, the smaller integral container is limited in size by the size of the side panel. Only a small amount of a condiment can be placed into the smaller container. In addition, since the side container opens toward the inside of the container, it also has the tendency to open during the food-scooping process.

Another disadvantage of prior smaller integral containers is that they have a tendency to collapse unless immediately filled with a condiment, and they also collapse as the condiment is removed. This makes it more difficult to obtain access to the remaining condiment.

SUMMARY OF THE INVENTION

The present invention addresses these problems by providing a container for holding at least two items and having at least two compartments formed from a unitary, die-cut blank of paperboard. In one embodiment, the unitary blank comprises conventional front, rear, bottom, and overlapping side panels that are normally associated with a scoop-type carton (the first compartment) into which a first item can be scooped. In another embodiment, the unitary blank comprises conventional front, bottom, side, and overlapping rear panels to form the first compartment. However, to provide a second compartment into which a second item can be placed, the blank further includes an auxiliary flap of paperboard material rotatably attached to what is nominally considered the top edge of the rear panel of the first compartment. The auxiliary flap is cut and scored to provide the panels necessary to construct the second compartment.

To form the container of the present invention in one embodiment, the panels of the first compartment are folded such that the side panels overlap. The side panels are affixed together by using adhesive means, such as glue, double-sided tape, or the like. In a second embodiment, the panels of the first compartment are folded such that the rear panels overlap and are affixed. In both embodiments, the panels of the second compartment are folded such that the side panels overlap, and the side panels are affixed together by using adhesive means in a similar manner. In one embodiment with overlapping side panels in the first compartment, after the container is formed, the first compartment is maintained in an open configuration while the second compartment is flat. In another embodiment with overlapping rear panels in the first compartment, both compartments are initially flat for ease of storage, transportation, etc.

The container thus comprises a second compartment that has a first position and a second position. In the first position, the flattened second compartment extends from the rear panel of the first compartment in such a manner that the second compartment initially forms a generally flat extension of the rear panel of the first compartment to aid in the scooping process. The extension formed by the flattened second compartment is contiguous with and in substantially the same plane as the plane of the rear panel of the first compartment. The closed bottom edge of the flattened second compartment faces the first item being scooped, so that the scooping action cannot cause the second compartment to expand. After the first item is scooped into the first compartment, the flattened second compartment is then rotated into the second position until it is adjacent to and extending substantially along or even close enough to abut the rear panel of the first compartment. It is then expanded to form the second compartment into which a second item can be placed.

The bottom panel of the second compartment is formed into a generally diamond shape. The bottom panel increases the available volume of the second compartment and enables larger amounts of condiments or other second items to be placed in the second compartment. In addition, the bottom panel of the second compartment is formed such that when the second compartment is expanded, the bottom panel can be pushed up into the second compartment to lock the bottom panel into place. This maintains the expanded form of the second compartment whether or not a second item is placed into the second compartment.

Thus, the present invention comprises a container for holding at least two items comprising at least two compartments; a first compartment comprising a front panel, a rear panel, and a bottom panel connected together along a plurality of lines; the front panel spaced apart from the rear panel; front side panels extending from the front panel; rear side panels extending from the rear panel; wherein the front side panels and the rear side panels overlap and are affixed when the front panel, rear panel, and bottom panel are folded along the plurality of lines to form said first compartment; a second compartment extending from the first compartment, the second compartment comprising a front small panel; a rear small panel connected to the front small panel and connected to the rear panel of said first compartment; a bottom small panel between the front small panel and the rear small panel; the second compartment rotatably attached by the rear small panel to the rear panel of the first compartment, wherein the second compartment is rotated from a first position extending substantially in the plane of the rear panel of the first compartment in which the second compartment is used to scoop a first item into the first compartment to a second position adjacent to and extending along or even close enough to abut the rear panel in which the second compartment is expanded and a second item is placed into the second compartment, and such that when the second compartment is expanded, the bottom small panel locks in place when the bottom small panel is pushed up into the second compartment.

BRIEF DESCRIPTION OF THE DRAWINGS

The foregoing and other features and advantages of the invention will be apparent from the following, more particular description of embodiments of the invention, as illustrated in the accompanying drawings wherein like reference numbers generally indicate identical, functionally similar, and/or structurally similar elements and refer to like elements throughout, and in which:

FIGS. 4 and 5 show how the second compartment is rotated to the second position.

FIG. 6 illustrates a rear view of the container with the second compartment in the second position.

FIG. 7 is a top view of the container with the second compartment in the second position after the second compartment is expanded.

FIG. 8 shows a top view of the container after the second compartment is rotated to the second position.

FIG. 9 shows a rear view of the container with the second compartment in the second position after the second compartment is expanded.

FIG. 10 is a front perspective view of the container with the second compartment in the second position after the second compartment is expanded.

FIG. 11 is a rear perspective view of the container with the second compartment in the second position after the second compartment is expanded.

FIG. 12 is a perspective view of another embodiment of the present invention.

FIG. 13 is a perspective view of the embodiment of FIG. 12 showing the second compartment in the first position.

FIG. 14 a perspective view of the embodiment of FIG. 12 showing the second compartment in the second position.

DETAILED DESCRIPTION OF THE INVENTION

In describing the present invention illustrated in the figures, specific terminology is employed for the sake of clarity. The invention, however, is not intended to be limited to the specific terminology so selected, and it is to be understood that each specific element includes all technical equivalents that operate in a similar manner to accomplish similar functions.

With regard to all such embodiments as may be herein described and contemplated, it will be appreciated that optional features, including, but not limited to, aesthetically pleasing coloration and surface design, and labeling and brand marking, may be provided in association with the present invention, all without departing from the scope of the invention.

Figure 1:
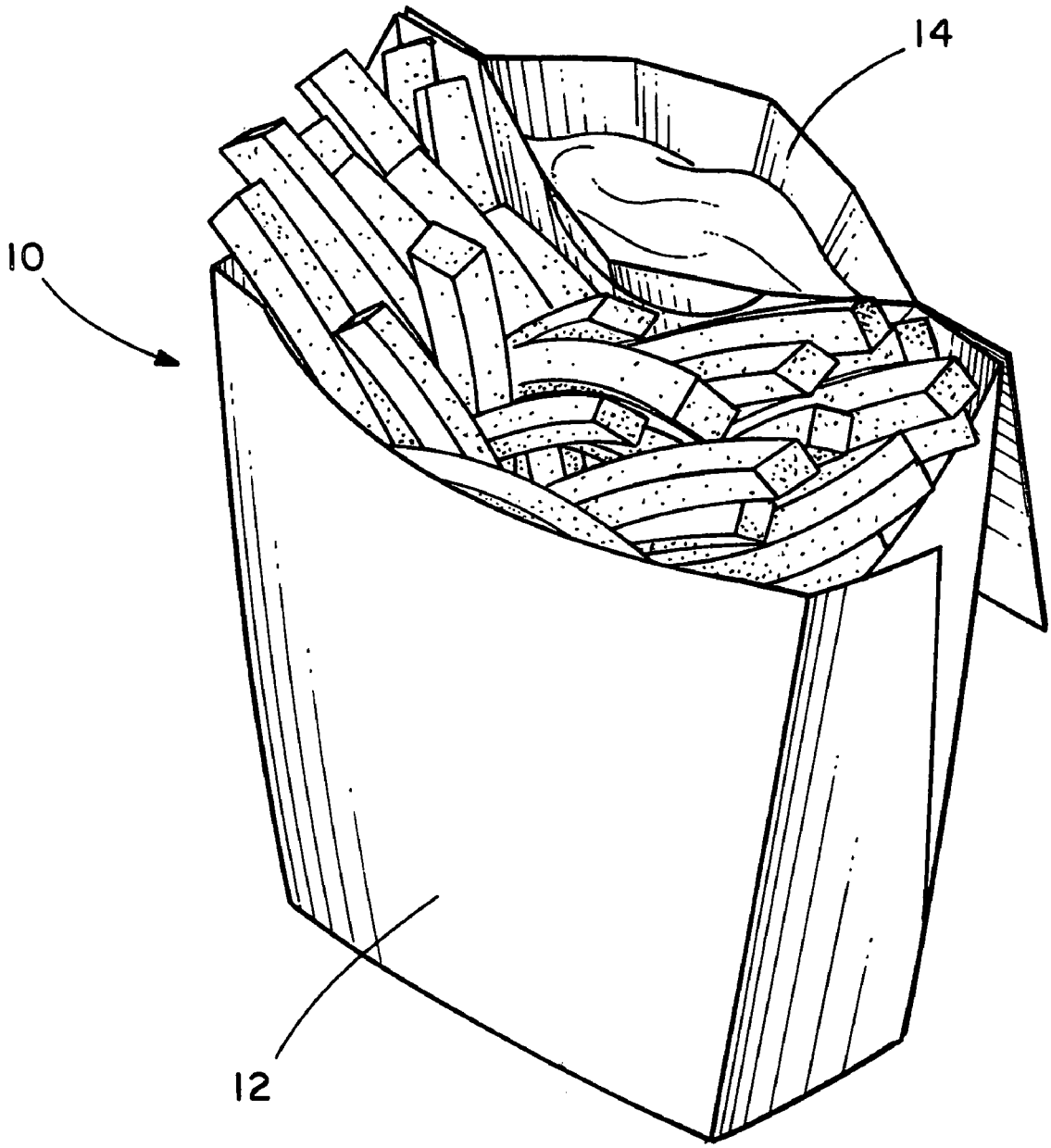
FIG. 1 is a perspective view of the container of the present invention.

Referring now to the drawings, wherein identical numerals indicate like parts, a container 10 is shown in FIG. 1 that comprises at least two compartments, a first compartment 12 and a second compartment 14 attached to the first compartment 12. In one embodiment, as shown in FIG. 1, the first compartment 12 is larger than the second compartment 14. However, it is to be understood that the first compartment 12 and the second compartment 14 can be of any size with relation to one another, for example, the first compartment 12 and the second compartment 14 can be equivalent in size, or the second compartment 14 can be larger than the first compartment 12, as will be evident to those skilled in the art, and any sizes of compartments 12, 14 are meant to be included within the scope of the present invention.

Figure 2:
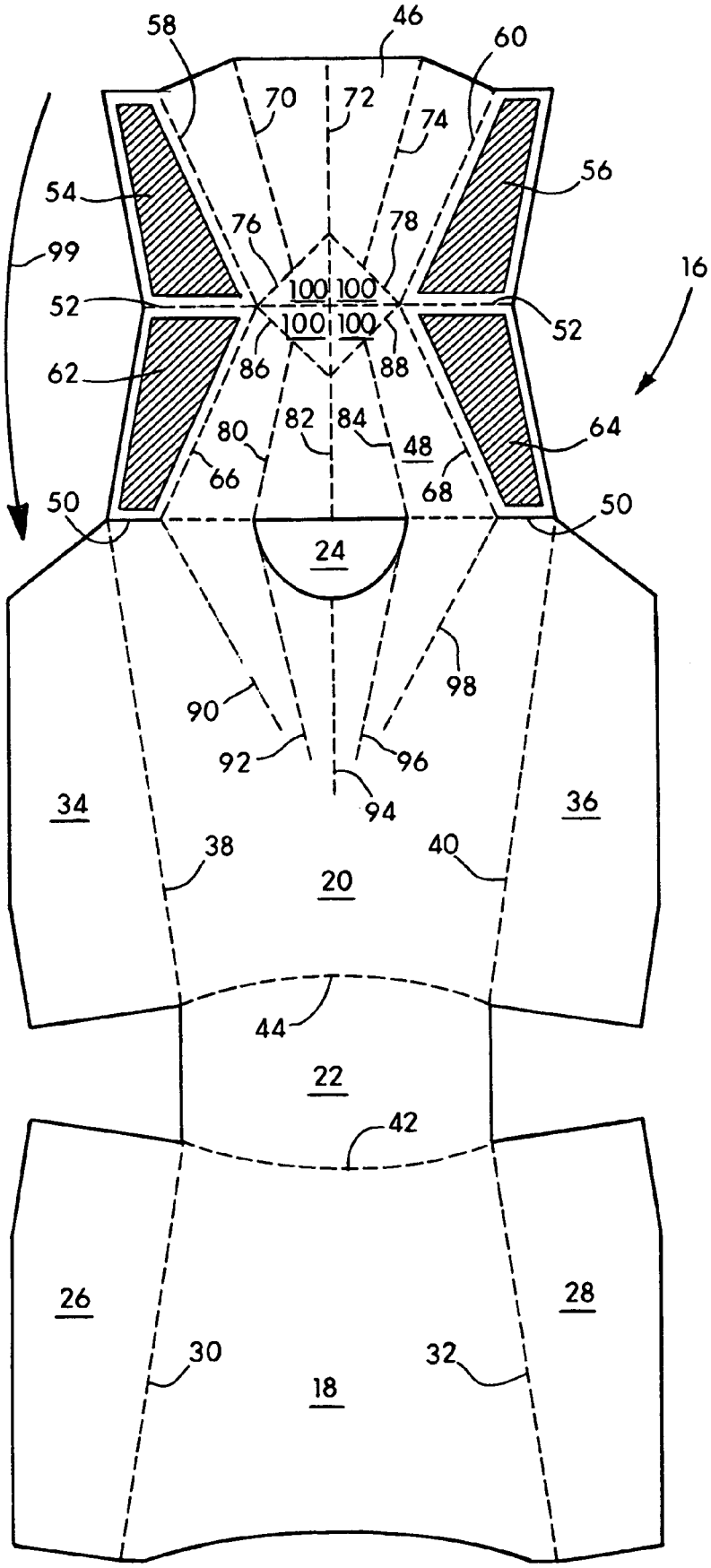
FIG. 2 shows the unitary blank from which the container is formed.

Directing attention to FIG. 2 of the drawings, a unitary blank 16 is die cut out of paperboard from which the container 10 of the present invention is constructed. Other sheet materials that are stiff, resilient, and foldable can be used instead of paperboard, as will be evident to those skilled in the art; for example, but not limited to, plastic materials, metal foil materials, etc.

Figure 3:
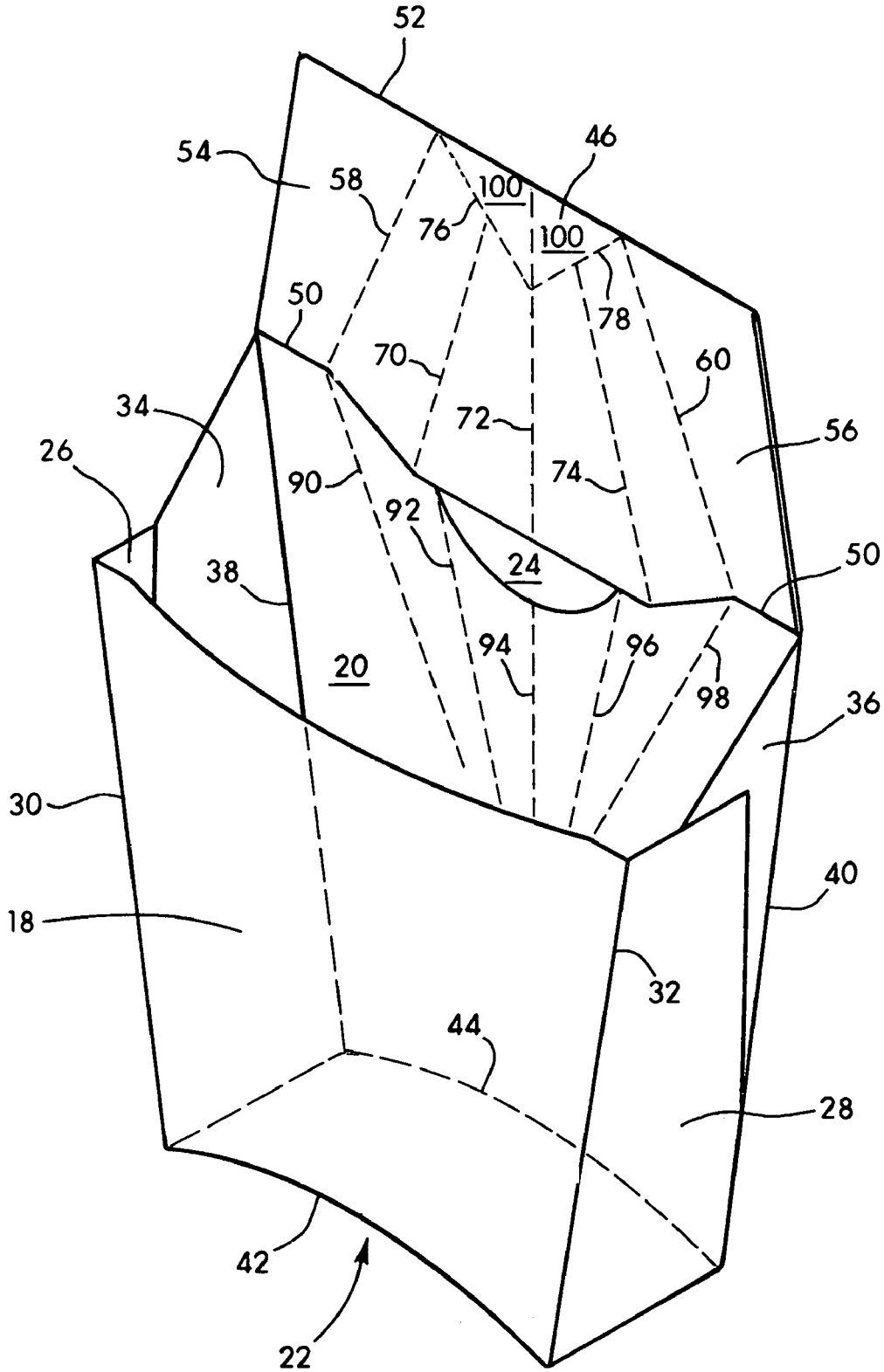
FIG. 3 illustrates the present invention with the second compartment in the first position.

The blank 16 of the embodiment illustrated in FIG. 2 comprises a front panel 18 spaced apart from a rear panel 20 and connected by a bottom panel 22. The rear panel 20 comprises a cutout 24, which in one embodiment of the invention is semicircular. However, it is to be understood that the cutout 24 can be of any shape desired. Front side panels 26, 28 extend from the front panel 18, and are delineated therefrom by semiperforated lines 30, 32. Rear side panels 34, 36 extend from the rear panel 20, and are delineated therefrom by semiperforated lines 38, 40. Semiperforated lines 42, 44 delineate the bottom panel 22 from the front panel 18 and the rear panel 20. As can be seen in FIGS. 1 and 3, the front panel 18, the rear panel 20, the bottom panel 22, the front side panels 26, 28 and the rear side panels 34, 36 fold together as described below to form the first compartment 12 of the container 10.

Extending from the rear panel 20 are the small panels 46, 48 that form the second compartment 14 rotatably attached to the first compartment 12. The rear small panel 48 extends from the rear panel 20 of the first compartment 12 and is delineated therefrom by a semiperforated line 50. The front small panel 46 extends from the rear small panel 48 and is delineated therefrom by a first semiperforated line 52. Front side flaps 54, 56 extend from the front small panel 46 and are delineated therefrom by semiperforated lines 58, 60. Rear side flaps 62, 64 extend from the rear small panel 48 and are delineated therefrom by semiperforated lines 66, 68.

The front small panel 46 is semiperforated along lines 70, 72, 74 and along angled lines 76, 78. The rear small panel 48 is semiperforated along lines 80, 82, 84 and along angled lines 86, 88. Delineated by angled lines 76, 78, 86, 88 is a bottom panel 100 of the second compartment 14.

The rear panel 20 of the first compartment 12 is further semiperforated along lines 90, 92, 94, 96, and 98, the ends of which are contiguous with the ends of lines 66, 80, 82, 84, 68, respectively, of the rear small panel 48.

Directing attention to FIG. 3, the first compartment 12 of the container 10 of the present invention is formed by folding the front panel 18 along lines 42, 44 generally upward and toward the rear panel 20, and folding along lines 30, 32 and lines 38, 40 such that the front side panels 26, 28 overlap the rear side panels 34, 36. The front side panels 26, 28 are then affixed to the rear side panels 34, 36 by any conventional method, such as, but not limited to, glue or double-sided tape.

The second compartment 14 of the container 10 is formed by folding the small front panel 46 along line 52 toward the small rear panel 48 and toward the inside of the first compartment 12 as shown by arrow 99 in FIG. 2, such that the front and rear small panels 46, 48 are aligned and generally flat, as shown in FIG. 3. The front side flaps 54, 56 then abut the rear side flaps 62, 64 and the flaps 54, 62 and 56, 64 are affixed together by any conventional method, such as, but not limited to, glue or double-sided tape, etc. In one embodiment, as shown in FIG. 2, the side flaps 54, 56, 62, 64 are pre-glued such that when the front side flaps 54, 62 and the rear side flaps 56, 64 are pressed together, the side flaps 54, 62 and 56, 64 become affixed.

When the side flaps 54, 62 and 56, 64 are thus affixed, the second compartment 14 extends in a first position from the rear panel 20 of the first compartment 12, as illustrated in FIG. 3. The extension formed by the flattened second compartment 14 in the first position is contiguous with and in substantially the same plane as that of the rear panel 20 of the first compartment 12. The second compartment 14 thus is positioned in the first position to act as part of a scoop with which to scoop a first item, such as a food item, into the first compartment 12. Because the second compartment 14 is formed by folding the front small panel 46 to meet the rear small panel 48 along line 52, the closed edge formed by line 52 is at the front of the scoop where it meets the first item being scooped. Thus, the second compartment 14 cannot be opened inadvertently by the force of the scooping motion.

After the first item is scooped or placed into the first compartment 12, the second compartment 14 is then rotated and expanded as shown in FIGS. 4–11. In FIGS. 4 and 5, the second compartment 14 is rotated 102 about line 50 from the first position to a second position such that the rear small panel 48 is adjacent to and extending substantially along or even abutting the rear panel 20 of the first compartment 12. FIG. 6 shows a back view of the container 10 of the present invention after the second compartment 14 is rotated 102 to the second position. FIG. 8 shows a top view of the container 10 after the second compartment 14 is rotated 102 to the second position. The second compartment 14 remains flattened initially after rotation as shown in FIGS. 6 and 8.

To expand the second compartment 14, as shown in FIGS. 7 and 8, so that a second item or several items can be placed within the second compartment 14, the front small panel 46 is first moved 104 away from the rear small panel 48. Since the top of the front small panel 46 extends above the cutout 24 in the rear panel 20 of the first compartment 12, one need only use a finger to pull 104 the top of the front small panel 46 away from the rear small panel 48, as shown in FIG. 7. The second compartment 14 in the second position can then be used as a holder for a second item.

As shown in FIG. 9, the second compartment 14 can be locked in the expanded position by pushing up 106 on the bottom panel 100 of the second compartment 12. The shape of the bottom panel 100 is such that the bottom panel 100 folds along lines 76, 78, 86, and 88 and along lines 52, 72, and 82 and locks in place when it is pushed up 106 into the second compartment 14. This enables the second compartment 14 to remain in an expanded configuration without further effort on the part of the user and enables a larger amount of a second item or items to be placed into the second compartment 14 because the volume of the second compartment 14 is increased thereby. The locking action of the bottom panel 100 also enables the second compartment 14 to remain expanded as the second item is gradually removed.

The expanded second compartment 14 is further illustrated in FIGS. 7, 10, and 11. It can be seen that when the front small panel 46 is pulled away from the rear small panel 48, the rear small panel 48 is folded along lines 66, 68, 80, 82, and 84, and extends 104 into the first compartment 12 along lines 90, 92, 94, 96, 98 in the rear panel 20. This extension 104 also pushes the rear panel 20 of the first compartment 12 into the first compartment 12. This further increases the volume of the second compartment 14 without significantly decreasing the volume of the first compartment 12. The pushing of the rear panel 20 into the first compartment 12 also assists in maintaining the second compartment 14 in the second position.

In one embodiment of the present invention, the container 10 is used for at least two food items, for example, but not limited to, french fries and ketchup, or salad and dressing, or cut vegetables and dip, or chips and dip, etc. More than two compartments could be provided and a mix of items could obviously be put in any one of the compartments (e.g., ketchup and mustard mixed together in the second compartment 14). Other food items will be immediately evident to those skilled in the art and are meant to be included in the present invention. For example, in this embodiment, when the first compartment 12 is expanded and the second compartment 14 is flattened and in the first position, the container 10 is used to scoop the first food item, such as french fries, via the extended, flattened second compartment 14 and into the first compartment 12. After the loaded container 10 is handed over to the customer, the customer then rotates 102 the second compartment 14 into the second position, expands 104, 106 the second compartment 14, and places the desired second item, such as a condiment, or a mix of condiments, therein.

In another embodiment of the present invention, the container 10 can be used for at least two nonfood items, such as but not limited to bolts and nuts. In this embodiment, when the first compartment 12 is expanded and the second compartment 14 is flattened and in the first position, the container 10 is used to scoop the first item, such as bolts, via the extended second compartment 14 into the first compartment 12. The second compartment 14 is then rotated 102 into the second position and expanded 104, 106, and the second item, such as nuts, is placed therein.

In another embodiment, the container 10 can be used to hold two items, such as an epoxy resin and a hardener, that are later mixed together to make an epoxy adhesive. In this embodiment, the first compartment 12 is expanded, the second compartment 14 is rotated 102 into the second position and expanded 104, 106, and the first item, such as epoxy resin, is placed directly into the first compartment 12 and the second item, such as a hardener, is placed directly into the second compartment 14.

In another embodiment of the present invention illustrated in FIGS. 12–14, the structure of the first compartment 12 is slightly modified. In this embodiment, the first compartment 12 comprises a front panel 18 and a rear panel 20 connected by a bottom panel 22. The rear panel 20 could be one piece or comprise a first section and a second section, which overlap and are affixed to form the rear panel 20. Front side panels 26, 28 extend from the front panel 18, and are delineated therefrom by semiperforated lines 30, 32. Rear side panels 34, 36 extend from the rear panel 20, and are delineated therefrom by semiperforated lines 38, 40. Semiperforated lines 31, 41 delineate the front side panels 26, 28 from the rear side panels 34, 36. Semiperforated lines 42, 44 delineate the bottom panel 22 from the front panel 18 and the rear panel 20. As can be seen in FIGS. 13 and 14, the front panel 18, the rear panel 20, the bottom panel 22, the front side panels 26, 28, and the rear side panels 34, 36 form the first compartment 12 of the container 10. This embodiment enables the container 10 to be stored flat after the first compartment 12 and the second compartment 14 are constructed by affixing their respective panels 20 and flaps 54, 56, 62, 64.

The second compartment 14 extends from the rear panel 20 of the first compartment 12 in the identical fashion as described hereinabove for the embodiment illustrated in FIGS. 1–11 and is identical in its construction. The method of use of the container 10 in this embodiment is identical to the method of use described hereinabove for the embodiment illustrated in FIGS. 1–11.

In a method for holding a first item and a second item in a container, the method comprises providing a first compartment having a rear panel; extending a second compartment from the rear panel of the first compartment in a first position; scooping the first item into the first compartment using the extended second compartment; rotating the second compartment from a first position to a second position adjacent to and extending substantially along or even close enough to abut the rear panel of the first compartment; expanding the second compartment; and placing the second item into the second compartment.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

We claim:

1. A container for holding at least two items comprising at least two compartments:

a first compartment comprising a front panel spaced apart from a rear panel and a bottom panel connected to said front panel and said rear panel;

a second compartment rotatably attached to said rear panel of said first compartment, said second compartment comprising:

a front small panel;

a rear small panel connected to said from small panel and rotatably connected to said rear panel of said first compartment, so that said front small panel extends substantially along said rear small panel;

wherein said second compartment is rotated from a first position extending along the plane of said rear panel to a second position in which said second compartment extends adjacent to and substantially along an exterior side of said rear panel and in which said front small panel continues to extend substantially along said rear small panel.

2. The container of claim 1 wherein said ax least two compartments are formed of a unitary blank of foldable material.

3. The container of claim 1 wherein said first compartment further comprises at least one side panel connected to said front panel and said rear panel.

4. The container of claim 1 wherein said first compartment further comprises:

front side panels extending from said front panel;

rear side panels extending from said rear panel;

said front panel, said rear panel and said bottom panel connected together along a plurality of lines wherein said front side panels and said rear side panels overlap and are affixed when said front, rear, and bottom panels are folded along said plurality of lines to form said first compartment.

5. The container of claim 1 wherein in said first position said second compartment is flattened and is used to scoop said first item into said first compartment and wherein in said second position said second compartment is expanded after rotation and said second item is placed into said second compartment.

6. The container of claim 5 wherein said second compartment further comprises:

front side flaps extending from said front small panel of said second compartment;

rear side flaps extending from said rear small panel of said second compartment;

wherein said front side flaps and said rear side flaps overlap and are affixed when said front small panel extends substantially along said rear small panel;

a bottom small panel between said front small panel and said rear small panel, such that when said second compartment is expanded, said bottom small panel locks said second compartment into said expanded position when said bottom small panel is pushed up into said second compartment.

7. The container of claim 6 wherein said second compartment when expanded pushes said rear panel of said first compartment into said first compartment, thus maintaining said second compartment in said second position.

8. A container for holding a first item and a second item comprising:

a first compartment comprising a front panel, a rear panel, and a bottom panel connected together along a plurality of lines;

front side panels extending from said front panel;

rear side panels extending from said rear panel;

wherein said front side panels and said rear side panels overlap and are affixed when said front panel, rear panel, and bottom panel are folded along said plurality of lines to form said first compartment;

a second compartment extending from said first compartment, said second compartment comprising:

a front small panel;

a rear small panel connected to said front small panel and connected to said rear panel of said first compartment;

a bottom small panel between said front small panel and said rear small panel;

said second compartment rotatably attached by said rear small panel to said rear panel of said first compartment, wherein said second compartment is rotated from a first position extending substantially in the plane of said rear panel in which said second compartment is used to scoop said first item into said first compartment to a second position extending adjacent to and substantially along said rear panel in which said second compartment is expanded and said second item is placed into said second compartment, and such that when said second compartment is expanded, said bottom small panel locks in place when said bottom small panel is pushed up into said second compartment.

9. The container of claim 8 wherein said first compartment and said second compartment are formed of a unitary blank of foldable material.

10. The container of claim 8 wherein said second compartment when expanded pushes said rear panel of said first compartment into said first compartment, thus maintaining said second compartment in said second position.

11. A container for holding a first item and a second item comprising:

a first compartment comprising a front panel, a rear panel comprising a first section and a second section, a bottom panel; and front side panels extending from said front panel and rear side panels extending from said rear panel, all of said panels connected together along a plurality of lines;

wherein said first section and said second section of said rear panel overlap and are affixed when said front panel, rear panel, bottom panel, and side panels are folded along said plurality of lines to form said first compartment;

a second compartment extending from said first compartment, said second compartment comprising:

a front small panel;

a rear small panel connected to said front small panel and connected to said rear panel of said first compartment;

a bottom small panel between said front small panel and said rear small panel;

said second compartment rotatably attached by said rear small panel to said rear panel of said first compartment, wherein said second compartment is rotated from a first position extending substantially in the plane of said rear panel in which said second compartment is used to scoop said first item into said first compartment to a second position adjacent to and extending substantially along said rear panel in which said second compartment is expanded and said second item is placed into said second compartment, and such that when said second compartment is expanded, said bottom small panel locks in place when said bottom small panel is pushed up into said second compartment.

12. The container of claim 11 wherein said first compartment and said second compartment are formed of a unitary blank of foldable material.

13. The container of claim 11 wherein said second compartment when expanded pushes said rear panel of said first compartment into said first compartment, thus maintaining said second compartment in said second position.

14. A method for holding at least two items in a container having at least two compartments comprising:

providing a first compartment comprising a front panel, a rear panel, and a bottom panel connected together along a plurality of lines, wherein front side panels extend from said front panel and rear side panels extend from said rear panel and wherein said front side panels and said rear side panels overlap and are affixed when said front panel, rear panel, and bottom panel are folded along said plurality of lines to form said first compartment;

providing a second compartment extending from said first compartment, said second compartment comprising a front small panel, a rear small panel connected to said front small panel and connected to said rear panel of said first compartment, so that said front small panel extends substantially along said rear small panel;

scooping a first item into said first compartment using said extended second compartment;

rotating said second compartment from said first position to a second position adjacent to and extending substantially along said rear panel of said first compartment and in which said front small panel continues to extend substantially along said rear small panel;

expanding said second compartment;

placing a second item into said second compartment.

15. A container for holding at least two items comprising at least two compartments:

a first compartment comprising a front panel spaced apart from a rear panel and a bottom panel connected to said front panel and said rear panel;

a second compartment rotatably attached to said rear panel of said first compartment;

wherein said second compartment is rotated from a first position extending along the plane of said rear panel to a second position in which said second compartment extends adjacent to and substantially along said rear panel;

wherein said at least two compartments are formed of a unitary blank of foldable material;

wherein said first compartment further comprises at least one side panel connected to said front panel and said rear panel;

said first compartment further comprising:

front side panels extending from said front panel;

rear side panels extending from said rear panel;

said front panel, said rear panel, and said bottom panel connected together along a plurality of lines wherein said front side panels and said rear side panels overlap and are affixed when said front, rear, and bottom panels are folded along said plurality of lines to form said first compartment wherein in said first position said second compartment is flattened and is used to scoop said first item into said first compartment and wherein in said second position said second compartment is expanded and said second item is placed into said second compartment;

said second compartment further comprising:

a front small panel and a rear small panel connected together along a first line;

front side flaps extending from said front small panels of said second compartment;

rear side flaps extending from said rear small panels of said second compartment;

wherein said front side flaps and said rear side flaps overlap and are affixed when said front small panel and said rear small panel are folded along said first line;

a bottom small panel between said front small panel and said rear small panel, such that when said second compartment is expanded, said bottom small panel locks said second compartment into said expanded position when said bottom small panel is pushed up into said second compartment.

16. A container for holding at least two items comprising ax least two compartments:

a first compartment comprising a front panel spaced apart from a rear panel and a bottom panel connected to said front panel and said rear panel;

a second compartment rotatably attached to said rear panel of said first compartment;

wherein said second compartment is rotated from a first position extending along the plane of said rear panel to a second position in which said second compartment extends adjacent to and substantially along said rear panel;

wherein said at least two compartments are formed of a unitary blank of foldable material;

said first compartment further comprising:

at least one side panel connected to said front panel and said rear panel;

front side panels extending from said front panel;

rear side panels extending from said rear panel;

said front panel, said rear panel, and said bottom panel connected together along a plurality of lines wherein said front side panels and said rear side panels overlap and are affixed when said front, rear, and bottom panels are folded along said plurality of lines to form said first compartment wherein in said first position said second compartment is flattened and is used to scoop said first item into said first compartment and wherein in said second position said second compartment is expanded and said second item is placed into said second compartment said second compartment further comprising:

a front small panel and a rear small panel connected together along a first line;

front side flaps extending from said front small panels of said second compartment;

rear side flaps extending from said rear small panels of said second compartment;

wherein said front side flaps and said rear side flaps overlap and are affixed when said front small panel and said rear small panel are folded along said first line;

a bottom small panel between said front small panel and said rear small panel, such that when said second compartment is expanded, said bottom small panel locks said second compartment into said expanded position when said bottom small panel is pushed up into said second compartment;

wherein said second compartment when expanded pushes said rear panel of said first compartment into said first compartment, thus maintaining said second compartment in said second position.

17. A container for holding at least two items comprising at least two compartments:

a first compartment comprising a front panel spaced apart from a rear panel and a bottom panel connected to said front panel and said rear panel;

a second compartment rotatably attached to said rear panel of said first compartment, said second compartment comprising:

a front small panel and a rear small panel connected together along a first line;

front side flaps extending from said front small panels of said second compartment;

rear side flaps extending from said rear small panels of said second compartment;

wherein said front side flaps and said rear side flaps overlap and are affixed when said front small panel and said rear small panel are folded along said first line;

a bottom small panel between said front small panel and said rear small panel, such that when said second compartment is expanded, said bottom small panel locks said second compartment into said expanded position when said bottom small panel is pushed up into said second compartment.

18. The container of claim 17 wherein said second compartment when expanded pushes said rear panel of said first compartment into said first compartment, thus maintaining said second compartment in said second position.

* * * * *